US008579288B2

(12) United States Patent
Sampleton

(10) Patent No.: US 8,579,288 B2
(45) Date of Patent: Nov. 12, 2013

(54) GAME PIECES FOR MATH GAME AND METHOD THEREOF

(76) Inventor: Sylvia Marie Sampleton, Bowie, MD (US)

( * ) Notice: Subject to any disclaimer, the term of this patent is extended or adjusted under 35 U.S.C. 154(b) by 46 days.

(21) Appl. No.: 13/493,245

(22) Filed: Jun. 11, 2012

(65) Prior Publication Data

US 2013/0069304 A1 Mar. 21, 2013

Related U.S. Application Data

(60) Provisional application No. 61/536,252, filed on Sep. 19, 2011.

(51) Int. Cl.
*A63F 1/18* (2006.01)

(52) U.S. Cl.
USPC ..... 273/144 A

(58) Field of Classification Search
None
See application file for complete search history.

(56) References Cited

U.S. PATENT DOCUMENTS 7,775,798 B2 * 8/2010 Lucy ..... 434/128
7,857,315 B2 * 12/2010 Hoyt ..... 273/293
7,914,287 B2 * 3/2011 Nguyen ..... 434/204
7,927,103 B1 * 4/2011 Regan ..... 434/188
8,221,124 B2 * 7/2012 Ferguson et al. ..... 434/128
8,262,452 B2 * 9/2012 Okuaki et al. ..... 463/16
8,322,722 B1 * 12/2012 Criswell ..... 273/144 B
8,480,087 B1 * 7/2013 Traficant ..... 273/144 B
8,523,573 B1 * 9/2013 Villarreal-Reyes ..... 434/129
8,523,650 B2 * 9/2013 Kelly et al. ..... 463/16
2007/0167210 A1 * 7/2007 Kelly et al. ..... 463/16
2007/0259709 A1 * 11/2007 Kelly et al. ..... 463/20
2008/0254893 A1 * 10/2008 Patel et al. ..... 463/42

* cited by examiner

*Primary Examiner* — Kurt Fernstrom
*Assistant Examiner* — Dolores Collins
(74) *Attorney, Agent, or Firm* — Ming Chow; Sinorica, LLC

(57) ABSTRACT

The invention features a game container including double sided tokens with math expressions on each side. The tokens are placed in a bubble pop machine which can be activated to eject the tokens. Players attempt to catch the ejected tokens in bubble pop bags. The players must then attempt to correctly match the tokens to a master pad, by placing a token with an expression on a space containing the equation matching said expression. The player that catches the most tokens and correctly matches them to the master pad is declared the winner of the game. Scrolls and an equation pad with equations are provided for players to refer to if the players need help or want to check their solutions before matching the tokens to the master pad. An electronic version presents virtual problems for the player to solve, awarding points for correctly answering math problems.

18 Claims, 10 Drawing Sheets

5

7

Multiplication X

| | | | | | | | | | | | |
|---|---|---|---|---|---|---|---|---|---|---|---|
| 1x1=1 | 2x1=1 | 3x1=3 | 4x1=4 | 5x1=5 | 6x1=6 | 7x1=7 | 8x1=8 | 9x1=9 | 10x1=10 | 11x1=11 | 12x1=12 |
| 1x2=2 | 2x2=3 | 3x3=9 | 4x4=16 | 5x5=25 | 6x6=36 | 7x7=49 | 8x8=64 | 9x9=81 | 10x10=100 | 11x11=121 | 12x12=144 |
| 1x3=3 | 2x3=6 | 3x4=12 | 4x5=20 | 5x6=30 | 6x7=42 | 7x8=56 | 8x9=72 | 9x10=90 | 10x11=110 | 11x12=132 | |
| 1x4=4 | 2x4=8 | 3x5=15 | 4x6=24 | 5x7=35 | 6x8=48 | 7x9=63 | 8x10=80 | 9x11=99 | 10x12=120 | | |
| 1x5=5 | 2x5=10 | 3x6=18 | 4x7=28 | 5x8=40 | 6x9=54 | 7x10=70 | 8x11=88 | 9x12=108 | | | |
| 1x6=6 | 2x6=12 | 3x7=21 | 4x8=32 | 5x9=45 | 6x10=60 | 7x11=77 | 8x12=96 | | | | |
| 1x7=7 | 2x7=14 | 3x8=24 | 4x9=36 | 5x10=50 | 6x11=66 | 7x12=84 | | | | | |
| 1x8=8 | 2x8=16 | 3x9=27 | 4x10=40 | 5x11=55 | 6x12=72 | | | | | | |
| 1x9=9 | 2x9=18 | 3x10=30 | 4x11=44 | 5x12=60 | | | | | | | |
| 1x10=10 | 2x10=20 | 3x11=33 | 4x12=48 | | | | | | | | |
| 1x11=11 | 2x11=22 | 3x12=36 | | | | | | | | | |
| 1x12=12 | 2x12=24 | | | | | | | | | | |

91

91

9

FIG. 8

5

8

Division ÷

| | | | | | | | | | | | |
|---|---|---|---|---|---|---|---|---|---|---|---|
| 1÷1=1 | 2÷1=2 | 3÷1=3 | 4÷1=4 | 5÷1=5 | 6÷1=6 | 7÷1=7 | 8÷1=8 | 9÷1=9 | 10÷1=10 | 11÷1=11 | 12÷1=12 |
| 2÷2=1 | 4÷2=2 | 9÷3=3 | 16÷4=4 | 25÷5=5 | 36÷6=6 | 49÷7=7 | 64÷8=8 | 81÷9=9 | 100÷10=10 | 121÷11=11 | 144÷12=12 |
| 3÷3=1 | 6÷3=2 | 12÷4=3 | 20÷5=4 | 30÷6=5 | 42÷7=6 | 56÷8=7 | 72÷9=8 | 90÷10=90 | 110÷11=10 | 132÷12=11 | |
| 4÷4=1 | 8÷4=2 | 15÷5=3 | 24÷6=4 | 35÷7=5 | 48÷8=6 | 63÷9=7 | 80÷10=8 | 99÷11=9 | 120÷12=10 | | |
| 5÷5=1 | 10÷5=2 | 18÷6=3 | 28÷7=4 | 40÷8=5 | 54÷9=6 | 70÷10=7 | 88÷11=8 | 108÷12=9 | | | |
| 6÷6=1 | 12÷6=2 | 21÷7=3 | 32÷8=4 | 45÷9=5 | 60÷10=6 | 77÷11=7 | 96÷12=8 | | | | |
| 7÷7=1 | 14÷7=2 | 24÷8=3 | 36÷9=4 | 50÷10=5 | 66÷11=6 | 84÷12=7 | | | | | |
| 8÷8=1 | 16÷8=2 | 27÷9=3 | 40÷10=4 | 55÷11=5 | 72÷12=6 | | | | | | |
| 9÷9=1 | 18÷9=2 | 30÷10=3 | 44÷11=4 | 60÷12=5 | | | | | | | |
| 10÷10=1 | 20÷10=2 | 33÷11=3 | 48÷12=4 | | | | | | | | |
| 11÷11=1 | 22÷11=2 | 36÷12=3 | | | | | | | | | |
| 12÷12=1 | 24÷12=2 | | | | | | | | | | |

92

92

9

FIG. 9

Multiplication-Division Bubble Pop Pad 12 9 91 9

| | | | | | | | | | | | |
|---|---|---|---|---|---|---|---|---|---|---|---|
| 1x1 =1 | 1x2=2 | 1x3=3 | 1x4=4 | 1x5=5 | 1x6=6 | 1x7=7 | 1x8=8 | 1x9=9 | 1x10=10 | 1x11=11 | 1x12=12 |
| 2x2=4 | 2x3=6 | 2x4=8 | 2x5=10 | 2x6=12 | 2x7=14 | 2x8=16 | 2x9=18 | 2x10=20 | 2x11=22 | 2x12=24 | 1÷1=1 |
| 3x3=9 | 3x4=12 | 3x5=15 | 3x6=18 | 3x7=21 | 3x8=24 | 3x9=27 | 3x10=30 | 3x11=33 | 3x12=36 | 4÷2=2 | 2÷1=2 |
| 4x4=16 | 4x5=20 | 4x6=24 | 4x7=28 | 4x8=32 | 4x9=36 | 4x10=40 | 4x11=44 | 4x12=48 | 9÷3=3 | 6÷2=3 | 3÷1=3 |
| 5x5=25 | 5x6=30 | 5x7=35 | 5x8=40 | 5x9=45 | 5x10=50 | 5x11=55 | 5x12=60 | 16÷4=4 | 12÷3=4 | 8÷2=4 | 4÷1=4 |
| 6x6=36 | 6x7=42 | 6x8=48 | 6x9=54 | 6x10=60 | 6x11=66 | 6x12=72 | 25÷5=5 | 20÷4=5 | 15÷3=5 | 10÷2=5 | 5÷1=5 |
| 7x7=49 | 7x8=56 | 7x9=63 | 7x10=70 | 7x11=77 | 7x12=84 | 36÷6=6 | 30÷5=6 | 24÷4=6 | 18÷3=6 | 12÷2=6 | 6÷1=6 |
| 8x8=64 | 8x9=72 | 8x10=80 | 8x11=88 | 8x12=96 | 49÷7=7 | 42÷6=7 | 35÷5=7 | 28÷4=7 | 21÷3=7 | 14÷2=7 | 7÷1=7 |
| 9x9=81 | 9x10=90 | 9x11=99 | 9x12=108 | 64÷8=8 | 56÷7=8 | 48÷6=8 | 40÷5=8 | 32÷4=8 | 24÷3=8 | 16÷2=8 | 8÷1=8 |
| 10x10=100 | 10x11=11 | 10x12=120 | 81÷9=9 | 72÷8=9 | 63÷7=9 | 54÷6=9 | 45÷5=9 | 36÷4=9 | 27÷3=9 | 18÷2=9 | 9÷1=9 |
| 11x11=121 | 11x12=132 | 100÷10=10 | 90÷9=10 | 80÷8=10 | 70÷7=10 | 60÷6=10 | 50÷5=10 | 40÷4=10 | 30÷3=10 | 20÷2=10 | 10÷1=10 |
| 12x12=144 | 121÷11=11 | 110÷10=11 | 99÷9=11 | 88÷8=11 | 77÷7=11 | 66÷6=11 | 55÷5=11 | 44÷4=11 | 33÷3=11 | 22÷2=11 | 11÷1=11 |
| 144÷12=12 | 132÷11=12 | 120÷10=12 | 108÷9=12 | 96÷8=12 | 84÷7=12 | 72÷6=12 | 60÷5=12 | 48÷4=12 | 36÷3=12 | 24÷2=12 | 12÷1=12 |

91 12 92 92

FIG. 10

GAME PIECES FOR MATH GAME AND METHOD THEREOF

The current application claims a priority to U.S. 61/536,252 filed on Sep. 19, 2011.

FIELD OF THE INVENTION

The present invention relates generally to a math game, an apparatus for a math game, and a method for playing a math game.

BACKGROUND OF THE INVENTION

The is a stigma that math is difficult and challenging. Many children are not able to think about math concepts abstractly. When children are rushed into working with math in an abstract manner before applying math using manipulatives, they often have difficulty. Basic math skills are necessary to provide the foundation to achieve in math. Unfortunately, basic math skills are often difficult to teach as they rely on rote memorization. While a teacher can present examples to help a child understand why when two numbers are added to result in a third number, learning basic math such as the multiplication table essentially comes down to being able to remember the answers to a foundation of basic math equations. The present invention provides a fun and interactive method to help children learn and remember the basic principles which will serve as a foundation for learning more abstract concepts in math.

SUMMARY OF THE INVENTION

The present invention provides an interactive method of teaching and reinforcing math lessons such as multiplication and division equations. The invention is a multiplication/division memory game. The invention features a bubble pop machine which contains tokens. The tokens feature expressions from categories like multiplication and division, such as 2*2 or 4÷2. The tokens include one category of expressions on a first face, and a different categories of expression on an opposite face. The bubble pop machine "Pops" tokens up and out of the machine in midair. The players use bubble pop bags to catch the tokens. While in midair the players move swiftly in the direction of the popping tokens in order to catch as many tokens as possible falling into the popping bags. Each player has their own popping equation pad with all the equations on the front and back. Then the player places and matches the token to the correct equation by placing the tokens in the pocket of the master pad. Players are provided a double sided scroll that has the multiplication facts on one side and division equations on the other side. The scroll is a reference scroll/card that has all the facts on them so the player references the correct answers for each equation. The scrolls/cards have a strategic formula for memorizing each fact. For example, each fact starts with the double equation for the multiplication/division fact: 1×1, 2×2, 3×3, 4×4, 5×5, 6×6, 7×7, 8×8, 9×9, 10×10, 11×11, 12×12, and so on with the division (1/1, 2/2, 3/3, and so on).

A further aspect of an embodiment of the invention provides children the ability to use memory to recall rules and formulas and recognize patterns; use language to understand vocabulary, instructions, and explain their thinking; and use sequential ordering to solve multi-step problems.

Additional aspects, objectives, features, and advantages of the present invention will become apparent from the following description of the preferred embodiments with references to the attached drawings.

BRIEF DESCRIPTION OF THE DRAWINGS

FIG. 8 is a front view showing the first face of the equation pad of the present invention.

FIG. 9 is a rear view showing the opposite face of the equation pad of the present invention.

FIG. 10 is a front view showing the first face of the master pad of the present invention.

DETAIL DESCRIPTIONS OF THE INVENTION

Figure 1:
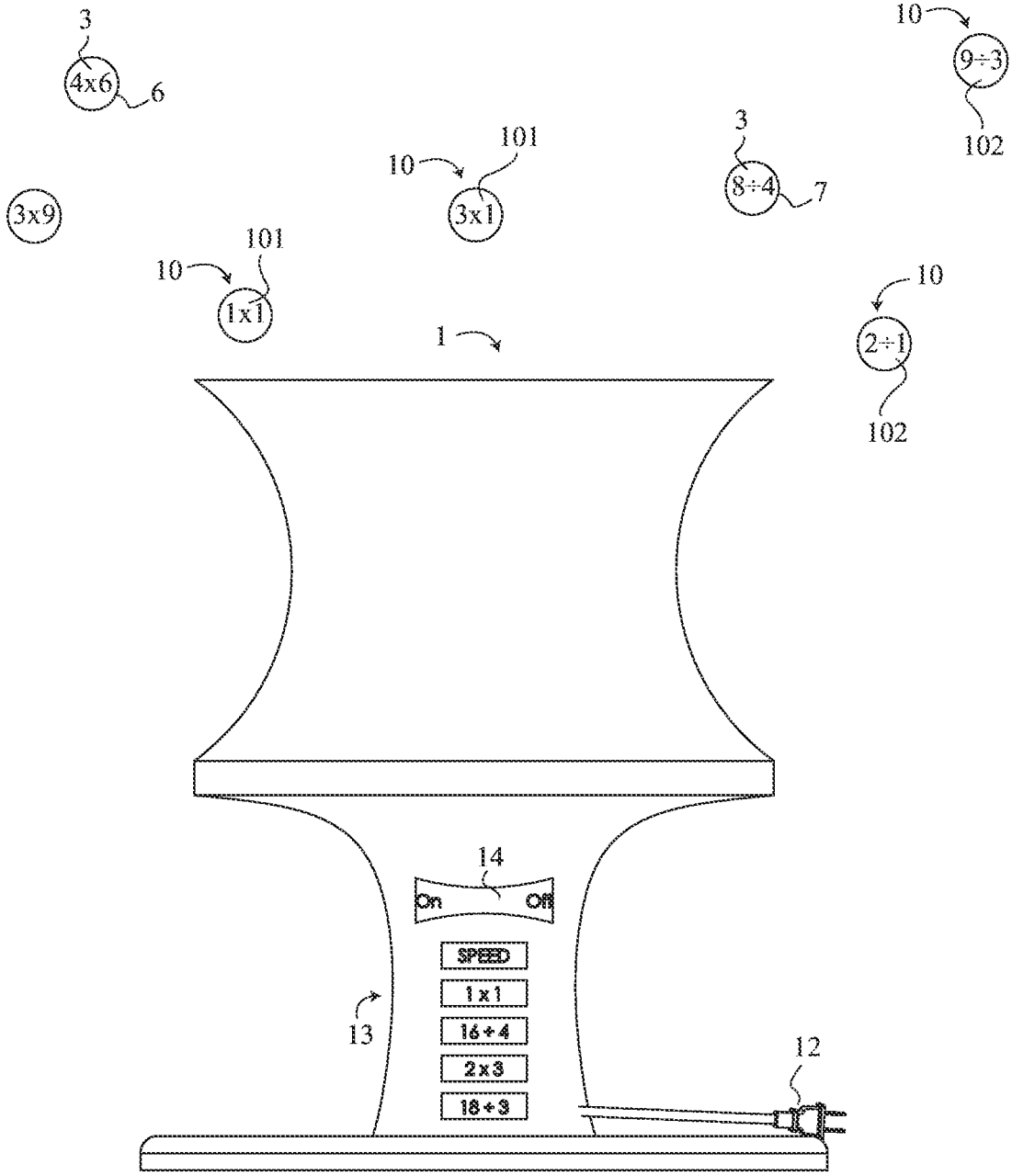
FIG. 1 is a front view of the bubble pop machine and tokens of the present invention.
Figure 2:
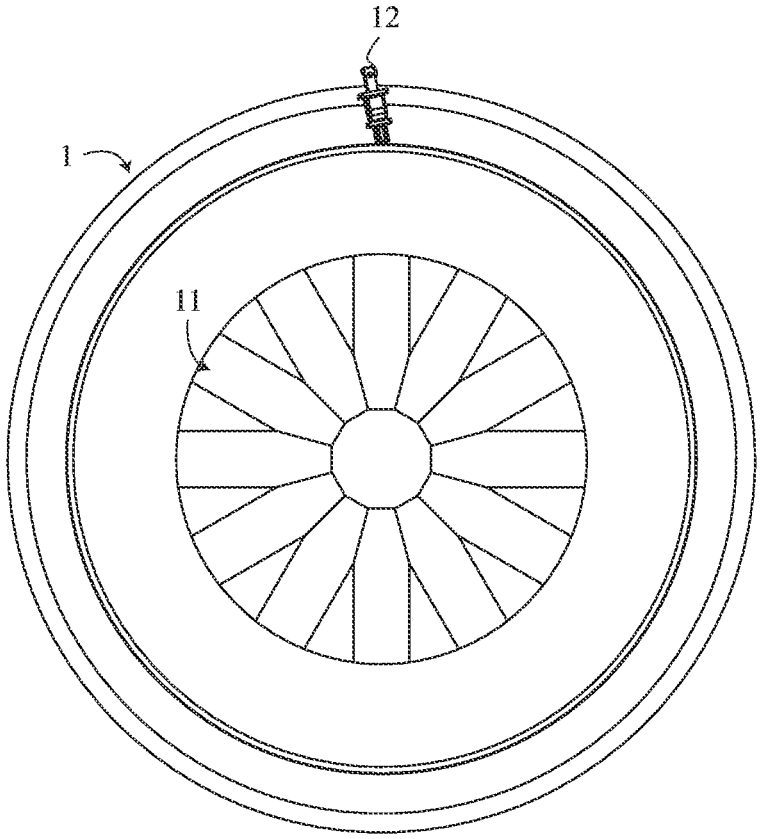
FIG. 2 is a top view of the bubble pop machine of the present invention.
Figure 3:
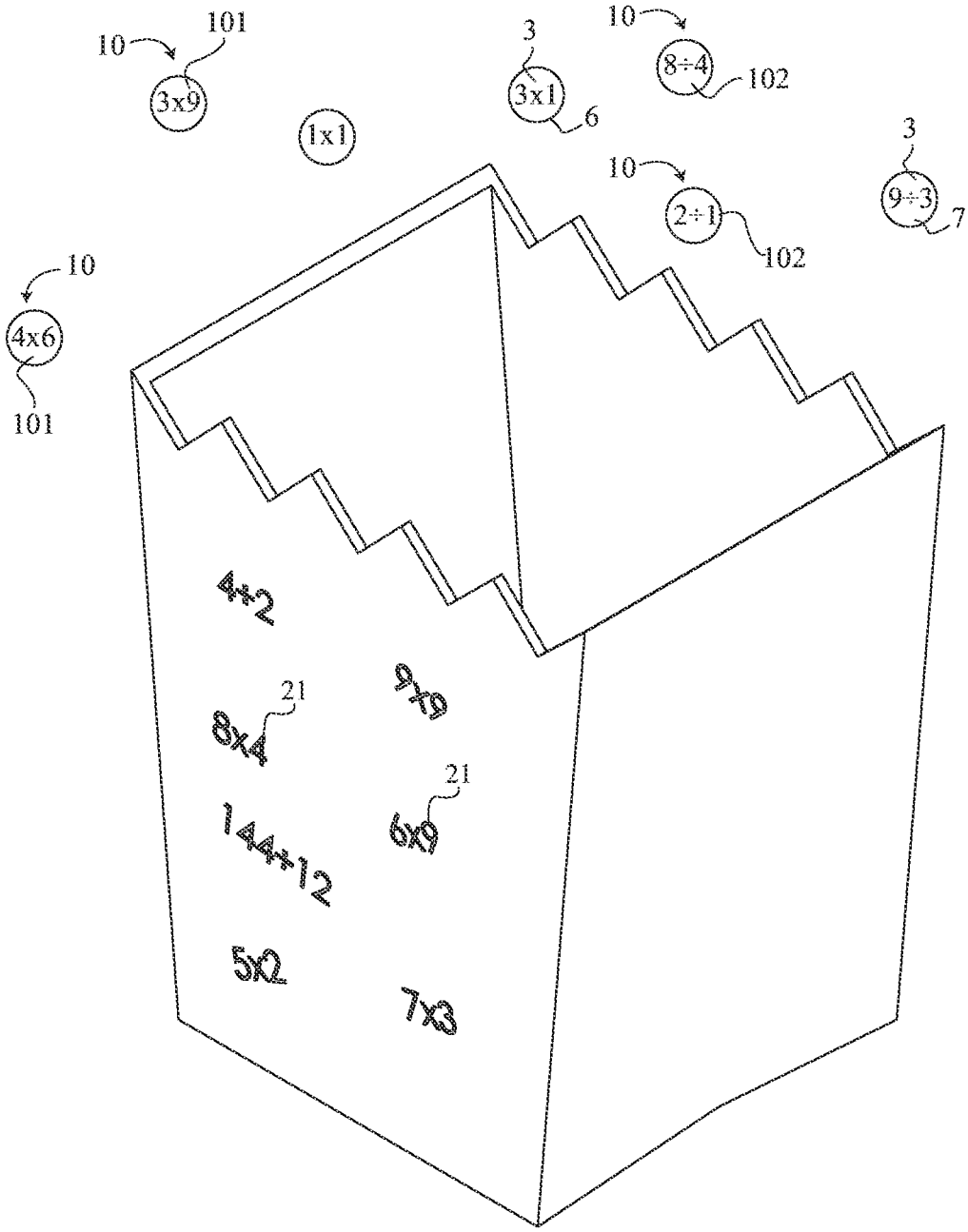
FIG. 3 is a perspective view of the bubble pop bag and tokens of the present invention.
Figure 4:
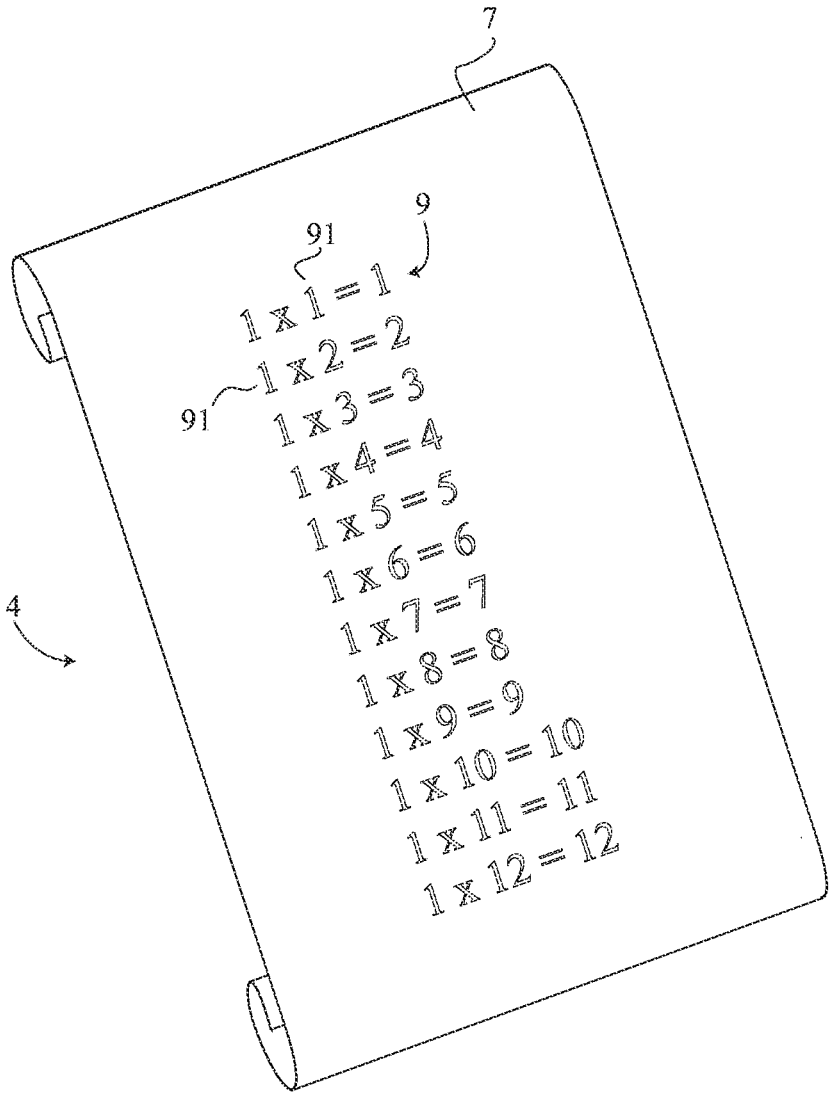
FIG. 4 is a perspective view of the first face of one of the scrolls of the present invention.
Figure 5:
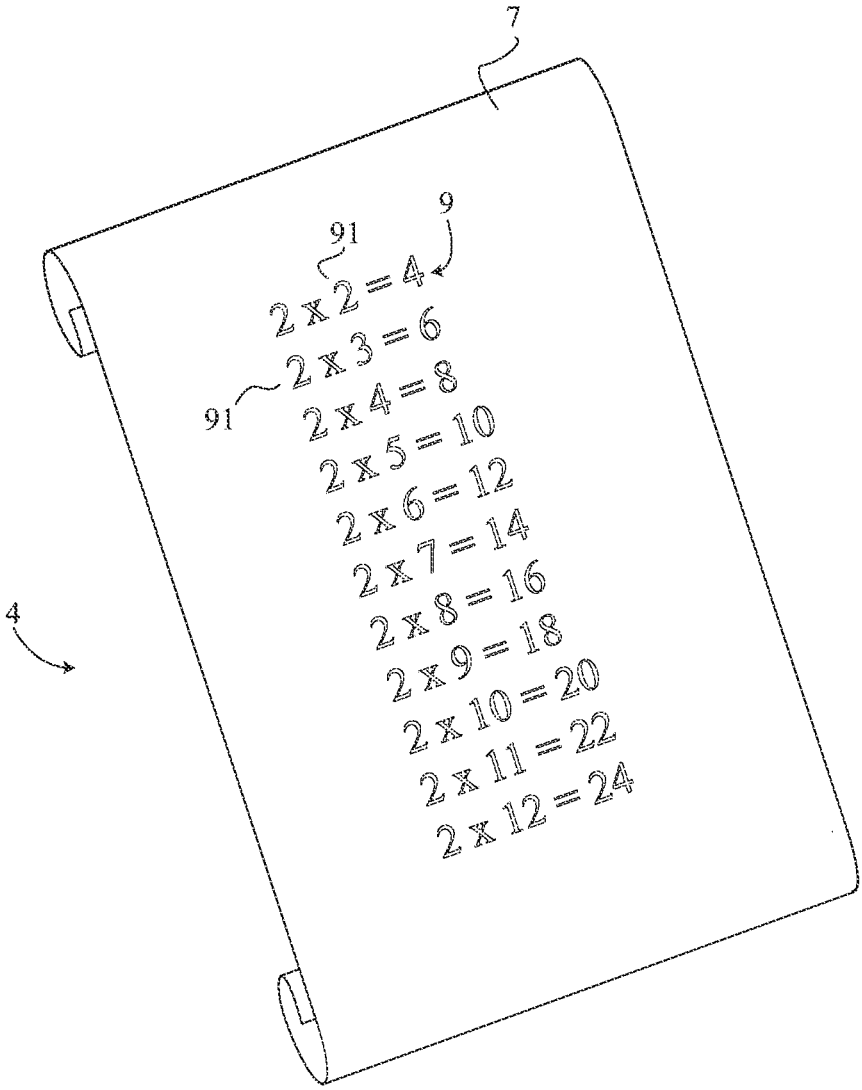
FIG. 5 is a perspective view of the first face of another of the scrolls of the present invention.
Figure 6:
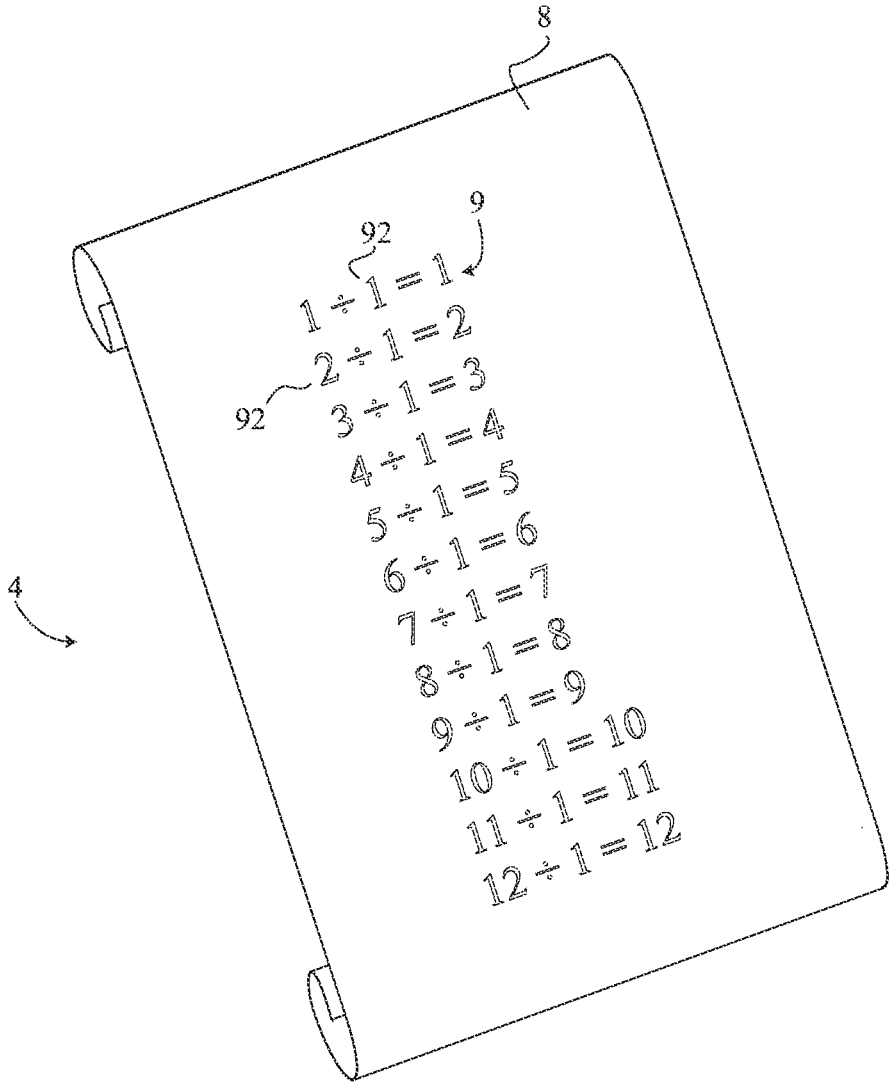
FIG. 6 is a perspective view of the opposite face of one of the scrolls of the present invention.
Figure 7:
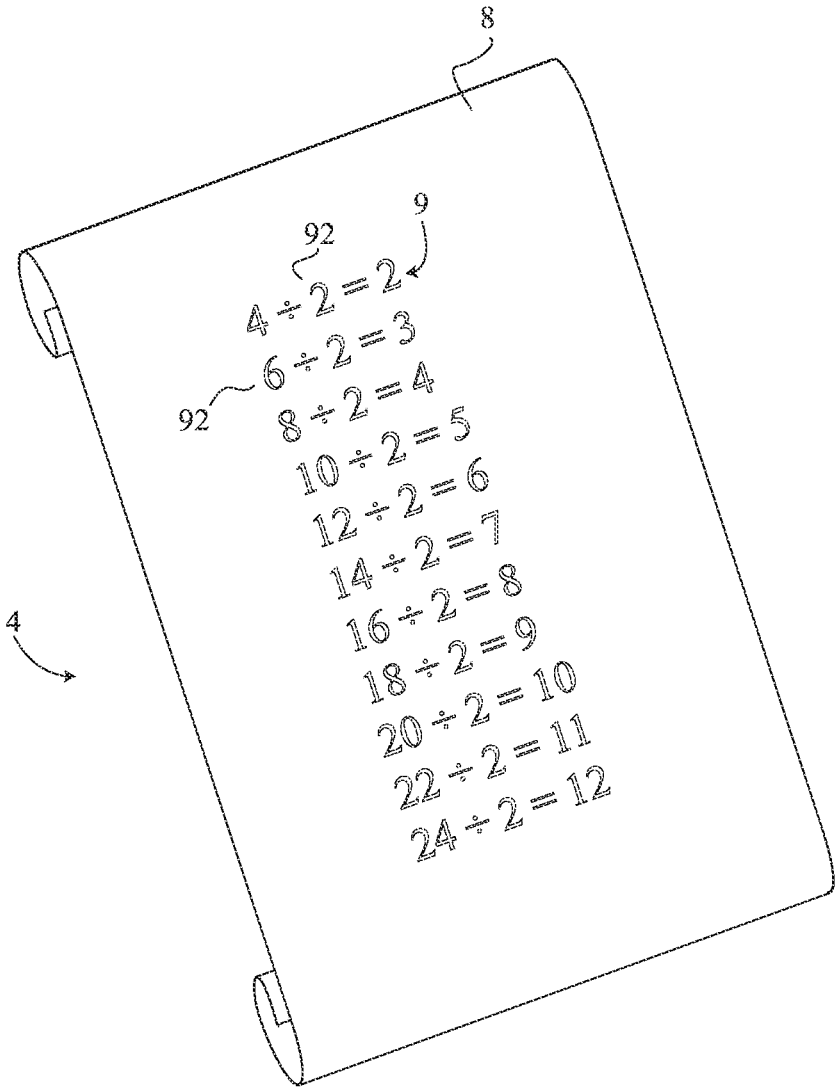
FIG. 7 is a perspective view of the opposite face of another of the scrolls of the present invention.

All illustrations of the drawings are for the purpose of describing selected versions of the present invention and are not intended to limit the scope of the present invention.

The set of game pieces comprise a bubble pop machine 1, a plurality of bubble pop bags 2, a plurality of tokens 3, a plurality of scrolls 4, an equation pad 5, and a master pad 6. The bubble pop machine 1 and the plurality of bubble pop bags 2 each include an open face such that they may receive the plurality of tokens 3. The plurality of tokens 3 also interact with the master pad 6.

The bubble pop machine 1 further comprises a ejection mechanism 11, a power supply 12, a speed setting mechanism 13, and a power switch 14. The bubble pop machine 1 also includes a bottom, a base plate, siding, and an open face opposite the base. The siding is preferably sloped so that the trajectories of ejected tokens 3 will be spread out. The ejection mechanism 11 is connected to the base plate, connected to the power supply 12, and connected to the speed setting mechanism 13. The speed setting mechanism 13 is located on the exterior face of the siding. The power switch 14 is located on the exterior face of the siding and is also connected to the power supply 12. The power supply 12 should be located on an exterior face of the bubble pop machine 1, either on the siding or the bottom. Mounting the power supply 12 on or near the bottom is preferable as it makes the power supply 12 more obscure and out of the way, resulting in the bubble pop machine 1 being more aesthetically pleasing.

The bubble pop machine's 1 primary function is to eject a plurality of tokens 3 contained in the power machine, wherein the contained tokens rest on the base plate and within the siding. The ejection mechanism 11 is a swirling rotation or undulation or a device for producing a current of air at a high rate of speed. In the preferred embodiment the ejection mechanism 11 is a fan, but in other embodiments the ejection mechanism 11 can be any device capable of imparting an impulse to the tokens 3, such that the tokens 3 are ejected from the bubble pop machine 1. For example, the ejection mechanism 11 could be driven by a simple spring, which is released from a compressed state to drive the base, and thus thrust the tokens 3, in an upward direction. Alternatively, the ejection mechanism 11 could include motors which would create a vacuum between the bottom and the base plate. This would increase pressure on the base plate, moving it down. Then, valves could equalize the pressure, which would drive the base plate back up towards an equilibrium position. Though different methods of driving the ejection mechanism 11 can be used, the cost and simplicity of the driving mechanism should be considered.

The power supply 12 provides power to drive the ejection mechanism 11, while the connected speed setting mechanism 13 will control how fast the ejection mechanism 11 ejects tokens 3. The speed setting mechanism 13 includes multiple speed settings. Selecting a lower speed setting would result in a slower fan speed, thus extending the amount of time it takes for the bubble pop machine 1 to eject all of the tokens 3. Selecting a higher speed setting would increase fan speed and result in the tokens 3 being ejected over a shorter time period. In an alternative embodiment the power supply 12 may be omitted, and the ejection mechanism 11 can be human powered. For example, a handle could be placed on the exterior facing of the siding and connected to the ejection mechanism 11. Rotating the handle would activate the ejection mechanism 11, where the specific number of rotations needed can vary. The handle could also be combined with the power supply 12, in which case the power supply 12 would turn the handle, instead of a user turning the handle.

In the preferred embodiment the bubble pop machine 1 has the following constraints. The bubble pop machine 1 has a roughly hourglass shape, designed to help scatter the tokens 3 instead of having the tokens 3 all land in the same spot. The bubble pop machine 1 has a capacity of roughly 2 quarts. The power supply 12 is preferably 600 watts, 1200 watts, or 1800 watts. There are four speed settings on the speed setting mechanism 13. The speed settings are marked by printed math expressions 10 rather than simple numbers. For example, instead of marking the speeds as 1, 2, 3, and 4, the speeds would be marked as 1×1, 1×2, 1×3, and 1×4.

The plurality of bubble pop bags 2 comprise a base, sides, and an open face at the top. Preferably the bubble pop bag 2 has a 16 ounce capacity and has jagged edges along the open face. In the preferred embodiment the bubble pop bag 2 also includes printed identifiers 21. These printed identifiers 21 can include numbers, shapes, and colors. For example, one bubble pop bag 2 might have a printed identifier 21 which includes a yellow triangle, a second bubble pop bag 2 might include a yellow circle, and a third bubble pop bag 2 might include a blue circle. The printed identifiers 21 could also include printed math expressions 10.

The plurality of tokens 3, the plurality of scrolls 4, the equation pad 5, and the master pad 6 are each a plane or planar and comprise a first face 7 and a opposite face 8. The first face 7 of each of the tokens 3 includes a first printed math expression 101. The opposite face 8 of each the tokens 3 includes a second printed math expression 102. The first face 7 of each of the scrolls 4 includes a first set of printed math equations 91. The opposite face 8 of each of the scrolls 4 includes a second set of printed math equations 92. The first face 7 of the equation pad 5 includes a first set of printed math equations 91, and the opposite face 8 of the equation pad 5 includes a second set of printed math equations 92. The master pad 6 has a plurality of pockets 12 located on a first face 7. Each of the pockets 12 on the first face 7 of the master pad 6 includes one equation from the first set of printed math equations 91 or one equation from the second set of printed math equations 92, solving a first printed math expression 101, or a second printed math expression 102. Thus, the entire first set of printed math equations 91 and second set of printed math equations 92 are represented on the master pad 6, with a single equation from the math equations 9 being printed on each pocket 12. The printed math equations 9 and printed math expressions 10 can focus on different types of math operations, with the first printed expressions 81 and first printed equations 91 using operations from a first category and the second printed expressions 82 and second printed equations 92 using operations from a second category. In the preferred embodiment, the two categories are multiplication and division. That means the first printed math expression 101 of the tokens 3 would be a printed multiplication expression, and the second printed math expression 102 of the tokens 3 would be a printed division expression. The first set of printed equations 91 of the scrolls 4, equation pad 5, and master pad 6 would include printed multiplication equations, and the second set of printed equations 92 of the scrolls 4, equation pad 5, and master pad 6 would include printed division equations. The first set of printed equations 91 of the master pad 6 would correlate to the first set of printed expressions 101 for multiplication expressions, and the second set of printed equations 92 of the master pad 6 would correlate to the second set of printed expressions 102 for division expressions. In other embodiments, different categories for the printed expressions 10 and equations 9 could be used. For example, the first printed expression 101 could be addition and the second printed expression 102 could be subtraction. Other combinations include multiplication and subtraction as well as division and addition.

To provide further explanation, a given token 3 might include the printed expression "3×5" on its first face 7 and "6÷3" on its opposite face 8. A given scroll 4 would include "3×5=15" on its first face 7 and "6÷3=2" on its opposite face 8. The equation pad 5 would include "3×5=15" on its first face 7 and "6÷3=2" on its opposite face 8. Likewise, the master pad 6 would included "3×5=15" and "6÷3=2" on its first face 7. Thus the above pieces could be used with a multiplication side or a division side, allowing the game to be used to develop multiple math skills.

In addition to the printed math equations 9 and expressions 10, the tokens 3 and the master pad 6 would have an interfacing method. The plurality of printed equations 9 on the master pad 6 are split between the plurality of pockets 12, with each pocket 12 including a single printed equation 9 from the first set of printed equations 91 or from the second set of printed equations 92. The pockets 12 are segmented from each other and are large enough to receive a token 3. The tokens 3 can be placed in or on the pockets 12 by various methods. In the preferred embodiment the tokens 3 are placed inside the pockets 12. In other embodiments, the master pad 6 can be placed on a flat surface and the tokens 3 then placed on the pockets 12, such that they are held in place by gravity. In other embodiments, where the equation pad 5 is held vertically on a wall, gravity would cause the tokens 3 to slide off the master pad 6. To secure the tokens 3 to a vertical master pad 6, additional components must be added to the master pad 6 and the tokens 3. These components could be simple such as hook-and-loop fasteners for attaching the tokens 3 to the master pad 6. Alternatively, magnets could be included on both the tokens 3 and the master pad 6, securing the tokens 3 to the master pad 6 through magnetic attraction. When selecting a method of attachment, drawbacks must be taken into account. For example, a hook-and-loop fastener method could obscure the printed equations 9 and expressions 10, while a magnetized system would add cost and weight.

In the preferred embodiment the tokens 3, scrolls 4, equation pad 5, and master pad 6 have the following constraints. There are 78 tokens 3, representing the multiplication table up through 12×12, without any repeats. For example, 1×5 and 5×1 are mathematically equivalent, so only one of those two expressions would be included. Thus, going from 1×1 to 12×12, there are a total of 78 unique expressions, and resultantly 78 tokens 3 are used. The scrolls 4 include multiplication tables on the first face 7 and division tables on the opposite face 8. Preferably, the multiplication tables are split across scrolls 4 (e.g. one scroll 4 includes 1×1 through 1×12, another includes 2×2 through 2×12), although in other embodiments the scrolls 4 may include a single multiplication table for 1×12 through 12×12. The division tables would be similarly split across scrolls 4. The tokens 3 are designed with a spherical shape. The materials used for the tokens 3, scrolls 4, equation pad 5, and master pad 6 should be inexpensive and lightweight. It is especially important for the tokens 3 to be lightweight so that the bubble pop machine 1 is capable of ejecting the tokens 3.

To play the math game an instructor and a group of players, such as students, are needed. The game pieces required, detailed above, are the bubble pop machine 1, the bubble pop bags 2, the tokens 3, the scrolls 4, the equation pad 5, and the master pad 6. Prior to starting the game, each player is given a bubble pop bag 2 and scrolls 4. The game can then be played as a competition between individual players or groups. To aid in the creation of groups, printed identifiers 21 are included on the bubble pop bags 2. These printed identifiers 21 can be colors, numbers, shapes, and even expressions. An instructor would quickly be able to group students by using the printed identifiers 21. For example, the instructor could organize players into a blue group, a red group, and a yellow group, where players in the blue group have a blue printed identifier 21 on their bubble pop bag 2, players in the red group have a red printed identifier 21 on their bubble pop bag 2, and players in the yellow group have a yellow printed identifier 21 on their bubble pop bag 2. Alternatively, the instructor could group students by the shapes on their bubble pop bags 2 (e.g. circles, triangles, and rectangles) or even math expressions 10. To group by math expressions 10, the teacher would simply form groups that have the same answer to the printed identifier 21. For example, if one player has 1+1 on their bubble pop bag 2, and another player has 4−2 on their bubble pop bag 2, they would be in the same group as both those expressions are equal to 2.

Since the game pieces have two sides, the instructor must decide which side is being used. For example, if the instructor wants to use multiplication, the instructor would turn the equation pad 5 so that the first face 6, which includes multiplication, is visible.

Once the players have been given their bubble pop bags 2 and scrolls 4, and groups have been assigned if necessary, the instructor can begin the game. The instructor begins by placing the equation pad 5 so that is viewable by all players, as well as placing the master pad 6 in a central area. The instructor then selects a speed setting and flips the power switch 14 in order to turn the bubble pop machine 1 on. Alternatively, the instructor may have a player select a speed setting. As the speed settings are labeled with expressions, the instructor would tell a player to select a speed setting equal to a number. The player would then have to read the expressions, and figure out which expression is equal to the number given by the instructor. For example, the instructor might tell a student to select speed setting "3". The student would then read the expressions, and move the speed setting to "3×1", the expression which equals "3".

For a faster pace of game play, the instructor may choose a higher speed setting, causing the tokens 3 to be ejected from the bubble pop machine 1 very quickly. If the instructor wants the players to be able to have more time to move and attempt to collect the tokens 3, the instructor may select a slower speed setting.

After turning the bubble pop machine 1 on, the tokens 3 are ejected from the bubble pop machine 1 by the ejection mechanism 11. The players then move to collect the tokens 3 ejected from the bubble pop machine 1. The players do so by attempting to catch the ejected tokens 3 in their bubble pop bags 2, before the ejected tokens 3 hit the ground. Any tokens 3 that are not caught by a player may be picked up by players and placed in the players' bubble pop bags 2. A player may only pick up tokens 3 that have fallen in an area next to the player. The players will continue to collect the tokens 3 until all of the tokens 3 have been placed into players' bubble pop bags 2.

When all the tokens 3 have been collected, the instructor gathers the players around the master pad 6. The players then take turns removing the tokens 3 from their bubble pop bags 2 and evaluating the math expressions 10 on the tokens 3. The instructor may allow a player to remove all their tokens 3 during a single turn, or only allow them to remove a single token 3 during each turn. The players will attempt to solve the printed expression on the same face as decided at the start of the game (e.g. first face 7 for multiplication or opposite face 8 for division). If a player has difficulty solving the expressions 10 on the tokens 3 they may refer to the printed equations 9 on the scrolls 4, equation pad 5, or master pad 6 for help. A player may also refer to the printed equations 9 on the scrolls 4, equation pad 5, or master pad 6 if they want to check the solution they have obtained for the printed expression.

Once a player has solved the printed math expression 10, they place the token 3 with said printed math expression 10 in one of the pockets 12 of the master pad 6 with the corresponding equation 9. For example, if a printed expression reads "5×5", then the player would place the token 3 in the master pad 6 pocket 12 with the printed equation 10 which reads "5×5=25".

Successfully matching a token 3 to the appropriate printed equation 9 on a pocket 12 is worth one point. The player with the most points is declared a successful contender. If the players have formed groups, the group whose players' point totals are greatest in sum is declared a successful contender.

The game may be played for multiple math categories, such as multiplication, division, addition, and subtraction. To use a different category, the instructor and players must simply flip the game pieces to the face with the appropriate printed equations 9, and expressions 10.

The game may also be played as an electronic version. The electronic version could be implemented in various forms, such as an app for a smartphone, tablet, or other mobile device. The electronic version could also be implemented as a hand held game. The electronic version would be a single player variant. In the electronic version, a device would generate a math problem and output the math problem to a display. The player would then use an interface to input a solution for that problem, scoring a point if the entered solution is the correct solution. The player would have the option of selecting a main category and a sub category for the math problems. The main category would allow a player to choose between multiplication, division, addition, and subtraction problems. The sub category would allow a player to choose a subset of problems from the main category. For example, the player could select multiplication as the main category, then choose numbers multiplied by 2 as the sub category. The device would then output problems where a first number is multiplied by 2. In this manner the player could improve their math skills through an electronic means.

Although the invention has been explained in relation to its preferred embodiment, it is to be understood that many other possible modifications and variations can be made without departing from the spirit and scope of the invention as hereinafter claimed.

What is claimed is:

1. A set of game pieces for playing a math game comprises, a bubble pop machine;

a plurality of bubble pop bags;

a plurality of tokens;

a plurality of scrolls;

an equation pad;

a master pad;

a plurality of printed math expressions;

a plurality of printed math equations the bubble pop machine comprises a ejection mechanism, a power supply, a speed setting mechanism, and a power switch;

each of the plurality of tokens, each of the plurality of scrolls, and the equation pad each comprise a first face and an opposite face;

the master pad comprises a first face and a plurality of pockets;

the first face of each of the plurality of tokens comprises a first printed math expression from the plurality of printed math expressions;

the opposite face of each of the plurality of tokens comprises a second printed math expression from the plurality of printed math expressions;

the first face of each of the plurality of scrolls, the first face of the equation pad, and the first face of the master pad each comprise a first set of printed math equations from the plurality of printed math equations;

the opposite face of each of the plurality of scrolls, the opposite face of the equation pad, and the first face of the master pad each comprise a second set of printed math equations from the plurality of printed math equations; and the first set of printed math equations and the second set of printed math equations on the master pad being positioned on the plurality of pockets, wherein a unique printed math equation is positioned on each of the plurality of pockets.

2. The set of game pieces for playing a math game as claimed in claim 1 comprises, wherein the first set of printed math expressions comprises multiplication expressions and the second set of printed math expressions comprises division expressions;

wherein the first set of printed math equations comprises a set of multiplication equations and the second set of printed math equations comprises a set of division equations;

wherein the first printed math expression corresponds to a first individual equation from the first set of printed math equations; and wherein the second printed math expression corresponds to a second individual equation from the second set of printed math equations.

3. The set of game pieces for playing a math game as claimed in claim 1 comprises, the plurality of bubble pop bags each bearing a printed identifier.

4. The set of game pieces for playing a math game as claimed in claim 3, wherein the printed identifier has a shape, a color, and a number.

5. A method of administrating a math game comprises the steps of:

providing a set of game pieces, wherein the set of game pieces comprises a bubble pop machine, a plurality of bubble pop bags, a plurality of tokens, a plurality of scrolls, an equation pad, a master pad, a plurality of printed math expressions, and a plurality of printed math equations;

providing a plurality of players;

dividing the plurality of players into a plurality of groups, wherein the plurality of groups each comprise a subset of the plurality of players;

placing the equation pad so that is visible by the plurality of players;

placing the master pad in a central area;

dividing the plurality of bubble pop bags between the plurality of players;

dividing the plurality of scrolls between the plurality of players;

placing the plurality of tokens into the bubble pop machine;

activating the bubble pop machine in order to eject the plurality of tokens from the bubble pop machine;

instructing the plurality of players to move and collect the plurality of tokens;

assembling the plurality of players around the master pad;

giving each of the plurality of players a turn and directing the plurality of players to match the plurality of tokens to the master pad during the turn;

awarding a point for correctly matching the plurality of tokens to the master pad; and declaring a particular group from the plurality of groups with the most points to be the winner.

6. The method of administering a math game as claimed in claim 5 further comprises the steps of:

forming the groups by calling out a particular printed identifier from a plurality of printed identifiers, wherein the plurality of printed identifiers are located on the plurality of printed bubble pop bags; and wherein each of the plurality of printed identifiers comprises a shape, a color, and a number.

7. The method of administering a math game as claimed in claim 5 further comprises the steps of:

switching the speed setting mechanism to a desired speed setting; and flipping the power switch in order to turn the bubble pop machine on.

8. The method of administering a math game as claimed in claim 5 further comprises the step of:

instructing the plurality of players to collect the plurality of tokens by catching the plurality of tokens in the plurality of bubble pop bags.

9. The method of administering a math game as claimed in claim 5 further comprises the step of:

instructing the plurality of players to collect a plurality of missed tokens in the plurality of bubble pop bags, wherein the plurality of missed tokens have fallen on a surface in an immediate area of the plurality of players.

10. The method of administering a math game as claimed in claim 5 further comprises the steps of:

directing the plurality of players to remove the plurality of tokens from the plurality of bubble pop bags; and directing the plurality of players to view and attempt to solve the plurality of printed math expressions on the plurality of tokens.

11. The method of administering a math game as claimed in claim 10, wherein the players may refer to the plurality of printed math equations on either the plurality of scrolls, the equation pad, or the master pad for help with correctly solving the plurality of printed math expressions.

12. The method of administering a math game as claimed in claim 5 further comprises the steps of:

directing the plurality of players to match a particular printed math expression from the plurality of printed math expressions to a particular printed math equation from the plurality of printed math equations on the master pad;

directing the plurality of players to place a particular token from the plurality of tokens in a particular pocket on the master pad; and wherein the particular token includes the particular printed math expression and the particular pocket includes the particular printed math equation.

13. A method of playing a math game comprises the steps of:

providing a set of game pieces, wherein the set of game pieces comprises a bubble pop machine, a plurality of bubble pop bags, a plurality of tokens, a plurality of scrolls, an equation pad, a master pad, a plurality of printed math expressions, and a plurality of printed math equations;

providing a plurality of other players, a visible equation pad, and a centralized master pad;

receiving a particular bubble pop bag from the plurality of bubble pop bags and a set of scrolls from the plurality of scrolls;

collecting the tokens ejected from the bubble pop machine in the plurality of bubble pop bags;

assembling around the equation pad; and receiving a turn and matching the plurality of tokens to the equation pad during the turn; and winning by accumulating the most points.

14. The method of playing a math game as claimed in claim 13 further comprises the step of:

collecting the plurality of tokens by moving to attempt to catch the plurality of tokens ejected from the bubble pop machine in a particular bubble pop bag.

15. The method of playing a math game as claimed in claim 13 further comprises the step of:

collecting a set of missed tokens from the plurality of tokens by placing the set of missed tokens into the particular bubble pop bag, wherein the missed tokens have fallen on a nearby surface.

16. The method of playing a math game as claimed in claim 13 further comprises the step of:

viewing a particular printed math expression from the printed math expressions on a particular token from the plurality of tokens by removing a particular token from the particular bubble pop bag.

17. The method of playing a math game as claimed in claim 16 further comprises the steps of:

attempting to solve the particular printed math expression on the particular token; and referring to the plurality of printed math equations on either the set of scrolls, the equation pad, or the master pad for help with correctly solving the particular printed math expression.

18. The method of playing a math game as claimed in claim 13 further comprises the steps of:

matching the particular printed math expression to a particular printed math equation from the plurality of printed math equations on the master pad; and placing the particular token in a particular pocket, wherein the particular pocket includes the particular printed answer.

* * * * *